United States Patent [19]

Takemura et al.

[11] Patent Number: 4,985,275

[45] Date of Patent: Jan. 15, 1991

[54] METHOD FOR PRODUCING A FUSED SILICA ENVELOPE FOR DISCHARGE LAMP

[75] Inventors: Tetsu Takemura, Himeji; Hidetoshi Ichinose, Fujisawa; Keisuke Ohkubo, Himeji; Akihiko Sugitani; Toshiyuki Okamoto, both of Takasago, all of Japan

[73] Assignee: Ushio Denki Kabushiki Kaisha, Tokyo, Japan

[21] Appl. No.: 405,571

[22] Filed: Sep. 8, 1989

Related U.S. Application Data

[62] Division of Ser. No. 870,960, Jun. 5, 1986, abandoned.

[51] Int. Cl.[5] ..... B05D 5/12; B05D 7/22; B05D 3/02

[52] U.S. Cl. ..... 427/106; 427/108; 427/126.2; 427/126.3; 427/226; 427/230; 427/235; 427/380; 313/634; 313/635; 313/636; 65/60.5; 65/60.52

[58] Field of Search ..... 427/106, 108, 126.2, 427/126.3, 226, 230, 235, 380, 443.2; 65/60.5, 60.52; 313/112, 634, 635, 636

[56] References Cited

U.S. PATENT DOCUMENTS

| | | | |
|---|---|---|---|
| 2,568,459 | 4/1951 | Noel | 313/635 |
| 2,757,305 | 7/1956 | Dziergwa | 313/634 X |
| 3,141,990 | 7/1964 | Ray | 427/106 |
| 3,219,868 | 11/1965 | Mason et al. | 313/635 X |
| 3,619,235 | 11/1971 | Furuuchi et al. | 427/169 |
| 3,841,858 | 10/1974 | Akashi et al. | 65/60.52 |
| 3,850,679 | 11/1974 | Sopko et al. | 65/60.52 |
| 3,988,628 | 10/1976 | Clausen | 313/635 X |
| 4,112,142 | 9/1978 | Schroder et al. | 427/169 |
| 4,129,434 | 12/1978 | Plumat et al. | 427/169 |
| 4,293,593 | 10/1981 | Yoldas | 427/106 |
| 4,361,598 | 11/1982 | Yoldas | 427/380 |
| 4,816,049 | 3/1989 | Hata et al. | 427/169 |

FOREIGN PATENT DOCUMENTS

| | | | |
|---|---|---|---|
| 52-39712 | 3/1977 | Japan | 65/60.52 |
| 54-21075 | 2/1979 | Japan | 427/106 |
| 54-47715 | 4/1979 | Japan | 65/60.52 |
| 1188015 | 4/1970 | United Kingdom | 313/635 |

*Primary Examiner*—Shrive Beck
*Assistant Examiner*—Margaret Bueker
*Attorney, Agent, or Firm*—Finnegan, Henderson, Farabow, Garrett & Dunner

[57] ABSTRACT

A method for producing a fused silica envelope for use in a discharge lamp in which the inner surface of a fused silica tube is coated with a formulation containing titanium alcoholate and the coating treated by the steps including baking at a temperature of at least 1720° C. to cause $TiO_2$ to diffuse into the tube. The method results in a Ti concentration in a range of 1 μm–10 μm from the inner surface of the wall of the envelope is 0.5%–7% in terms of $TiO_2$ and the product of the overall average Ti concentration and the thickness of the wall of the envelope ranges from 3.7% μm to 42% μm. During the baking step, the tube is shaped to include a bulb-like portion by inflating the silica tube.

4 Claims, 1 Drawing Sheet

METHOD FOR PRODUCING A FUSED SILICA ENVELOPE FOR DISCHARGE LAMP

This application is a division, of applicant Ser. No. 870,960, filed Jun. 5, 1986, now abandoned.

BACKGROUND OF THE INVENTION (1) Field of the Invention:

This invention relates to a fused silica envelope for a discharge lamp, and more specifically to a fused silica envelope suitable for use in providing an ozone-free discharge lamp.

(2) Description of the Prior Art:

Many of discharge lamps led by xenon lamps and mercury vapor lamps radiate light which contains an ultraviolet ray having a wavelength of 200 nm or shorter. An ultraviolet ray having a wavelength of 200 nm or shorter causes oxygen, which is contained in air, to react so that ozone is formed. Ozone is harmful to human bodies. Accordingly, its formation has to be avoided except that ozone is positively utilized for cleaning, sterilization or the like. Namely, it is necessary to prevent an ultraviolet ray having a wavelength of 200 nm or shorter from being given off from a discharge lamp. For this purpose, the envelopes of discharge lamps are formed with a so-called ozone-free fused silica glass which does not permit transmission of ultraviolet rays having wavelengths of 200 nm and shorter. A fused silica glass doped with $TiO_2$ and containing Ti atoms dispersed therein may, for example, be used as the ozone-free fused silica glass.

If an envelope made of a fused silica glass, in which Ti atoms are not evenly dispersed and the diffusion of the Ti atoms are hence non-uniform, is used for the fabrication of xenon lamp by way of example, tensile stresses are caused to occur in an inner surface layer of the wall of the envelope by ultraviolet rays radiated from the discharge arc. As a result, cracks occur in the envelope in a short period of time so that the service life of the xenon lamp is reduced. In some cases, strain was developed as early as several hours of lighting, resulting in fracture of the envelopes after lit for 100 hours or so.

The above problem does not arise if us is made on an envelope made of a high-quality, ozone-free, fused silica glass with Ti atoms dispersed uniformly therein. It is however necessary to melt $TiO_2$ and $SiO_2$ at an elevated temperature for many hours in order to produce a fused silica glass with Ti atoms dispersed uniformly. Its production is therefore very time-consuming and cumbersome and its price is accordingly high.

SUMMARY OF THE INVENTION

With the foregoing problems in view, the present invention has as its object the provision of a fused silica envelope which can be produced with ease, has good durability, prevents completely transmission of ultraviolet rays having wavelengths of 200 nm and shorter, and is hence suitable for use in an ozone-free discharge lamp.

In one aspect of this invention, there is thus provided a fused silica envelope for a discharge lamp, wherein the Ti concentration in a range of 1 μm–10 μm from the inner surface of the wall of the envelope is 0.5%–7% in terms of $TiO_2$ and the product of the overall average Ti concentration and the thickness of the wall of the envelope ranges from 3.7% μm to 42% μm.

The present invention has brought about numerous advantages. For example, it has made it possible to provide with ease a fused silica envelope suitable for use in an ozone-free discharge lamp which has good durability and can completely absorb ultraviolet rays having wavelengths of 200 nm and shorter.

The above and other objects, features and advantages of the present invention will become apparent from the following description and appended claim, taken in conjunction with the accompanying drawings.

DETAILED DESCRIPTION OF THE INVENTION AND PREFERRED EMBODIMENTS

The wall thicknesses of the envelopes of discharge lamps are generally 2–5 mm or so. In conventional ozone-free fused silica envelopes, $TiO_2$ is dispersed at a concentration of 100 ppm or so throughout the envelopes. Non-uniform diffusion of Ti atoms however tends to occur due to the nature of their production process. As understood from the above-described features of the present invention, unlike the conventional envelopes, a layer with $TiO_2$ dispersed at a high concentration therein is formed at the precisely-specified depth from the inner surface of the wall of an envelope according to this invention and the remaining major portion of the wall of the envelope may not always require diffusion of $TiO_2$. The present inventors have found that the problem of non-uniform diffusion of $TiO_2$ can be avoided in the above manner when its diffusion along the envelope is taken into consideration, leading to completion of the present invention.

The range in which $TiO_2$ is dispersed at a high concentration is limited to 1 μm to 10 μm from the inner surface for the following reasons. Namely, it is difficult to disperse $TiO_2$ only in a layer thinner than 1 μm in such a manner that conditions for ozone-free fused silica glass are met. On the other hand, it is also difficult to disperse $TiO_2$ at a high concentration in a layer deeper than 10 μm. Moreover, diffusion of $TiO_2$ to a depth beyond 10 μm is more or less prone to occurrence of its non-uniform diffusion.

Figure 1:
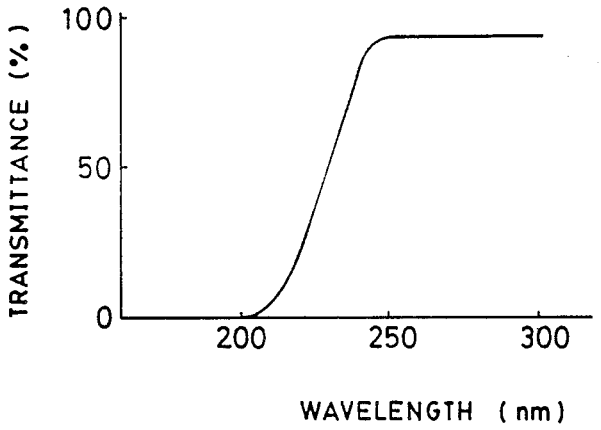
FIG. 1 is a curvilinear diagram showing u.v. transmission characteristics of a fused silica envelope according to the present invention.

The concentration of $TiO_2$ is determined in view of desired characteristics as an ozone-free fused silica glass and limitations imposed from a production technique to be employed for diffusing $TiO_2$ efficiently at such a high concentration. If the overall average concentration of $TiO_2$ and the thickness of the wall of an envelope falls within the range of 3.7% μm and 42% μm, u.v. transmission characteristics featuring complete absorption of ultraviolet rays of 200 nm and shorter can be obtained as shown in FIG. 1 by way of example. If the product is smaller than 3.7% μm, it is impossible to satisfy the conditions for ozone-free fused silica glasses. Any products greater than 42% μm result in absorption of ultraviolet rays having longer wavelengths. The $TiO_2$ concentration has been defined to 5%–7% within the narrow depth range from the inner surface of the wall of the envelope, because this specific depth range permits efficient diffusion of $TiO_2$ while satisfying the conditions for ozone-free fused silica glasses. Namely, any concentrations lower than 0.5% encounter difficulties in meeting the conditions for ozone-free fused silica glasses. On the other hand, it is difficult and wasteful to disperse $TiO_2$ efficiently at a high concentration higher than 7%.

Certain production examples will next be described to explain the fact that fused silica envelopes of this invention can be produced easily and efficiently.

In order to disperse $TiO_2$ at a high concentration in an extremely thin layer from the inner surface of the wall of an envelope, it is for example possible to diffuse $TiO_2$ from the inner surface or bake a $TiO_2$–$SiO_2$ glass layer, which contains $TiO_2$ at a high concentration, on the inner surface.

Figure 2:
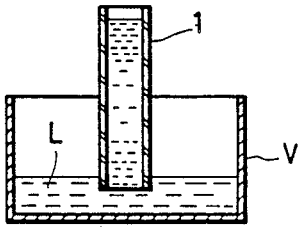
FIG. 2 schematically illustrates the production step of the fused silica envelope.

First of all, a description will be made of a process for diffusing $TiO_2$ from the inner surface. A coating formulation is prepared by using titanium tetraethoxide [$Ti(OC_2H_5)_4$] as a solute and adding, as a solvent, a mixture of ethanol as a principal component and a carboxylic acid such as acetic acid in such an amount that the concentration of the resultant coating formulation is 30 g/l or so in terms of $TiO_2$. As illustrated in FIG. 2, a starting fused silica tube 1 is placed at one of its open ends in the coating formulation L filled in a vessel V. Air is extracted from the interior of the tube 1 through the other open end thereof by means of an aspirator the illustration of which is omitted in the drawing, thereby allowing the coating formulation L to rise. By allowing the coating formulation L to descend while controlling its descending speed, the coating formulation is applied on the inner surface of the starting fused silica tube 1 to a certain thickness. The starting fused silica tube 1 with the coating formulation applied thereon is naturally dried, followed by its preheating at about 150° C. for 10 minutes and then by its heat treatment at a temperature of 250° C. or higher for 10 minutes. By this procedure, a layer of 0.1–1 μm thick is formed on the inner surface. The above procedure may be repeated as needed.

Thereafter, $TiO_2$ is caused to diffuse into the wall of the fused silica tube by a baking treatment. This can be done by heating the coated tube at a temperature of 1720° C. or higher, or preferably 1800° C. or higher by an oxyhydrogen burner. This treatment can be applied simultaneously with the formation of a bulb-like portion by inflating the tube 1 while maintaining the tube 1 in a heated and molten state by the oxyhydrogen burner. It is therefore unnecessary to add a separate apparatus and step specifically for the diffusion.

FIG. 1 is a curvilinear diagram showing the spectral transmittance of the wall of a fused silica envelope for a xenon discharge lamp, which has been treated in the above-described manner. The envelope is about 16 mm in inner diameter and about 2 mm in thickness. The envelope has been obtained by forming a thin layer of titanium oxide on its inner surface and then firing it at 800° C. for 10 minutes. The product of the overall average Ti concentration in terms of $TiO_2$ and the thickness of the wall of the envelope is 22 μm. This envelope is useful, for example, in fabricating a xenon discharge lamp having a rated power consumption of 1 KW. As shown by the curve in FIG. 1, the transmittance of light at wavelengths of less than approximately 200 nm is at a very low level, which as described above, is necessary to inhibit the production of ozone. The curve further shows that the transmittance of light at wavelengths greater than 200 nm increases rapidly in relation to small increases in wavelength so that transmittance of light at wavelengths above 250 nm reaches a very high level of 80% or higher.

Figure 3:
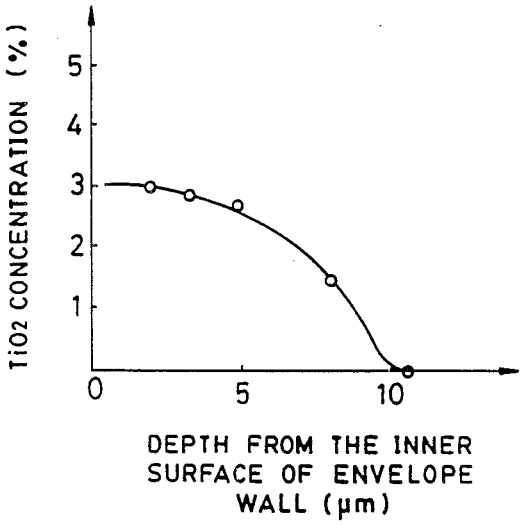
FIG. 3 is a curvilinear diagram showing the $TiO_2$ concentration as a factor of the depth from the inner surface of the wall of the envelope.

FIG. 3 is a curvilinear diagram showing the relationship between the $TiO_2$ concentration and the depth from the inner surface in the wall of the above envelope. As apparent from this drawing, it is readily envisaged that the $TiO_2$ concentration is about 3% to a depth of 5 μm or so from the inner surface and substantially no $TiO_2$ is diffused at the depth of 10 μm from the inner surface. The concentration and depth of diffused $TiO_2$ can be varied by controlling the concentration of the coating formulation L and its coated thickness, the temperature and time of the baking, etc.

The diffusion is completed by the above procedure. The application of the coating formulation can be effected with ease. The heat treatment of the coated layer of the coating formulation is complete at a low temperature in a short period of time. Moreover, the diffusion of $TiO_2$ is conducted at the same time as the formation of the bulb-like portion. The above operations are therefore very easy and efficient.

A description will next be made on a process for baking an amorphous $SiO_2$ layer, which contains $TiO_2$ at a high concentration, on the inner surface.

A liquid mixture of a titanium alcoholate and silicon alcoholate is prepared as a coating formulation. In this coating formulation, the concentration of titanium is controlled at 1–7% in terms of $TiO_2/(SiO_2+TiO_2)$. The application of the coating formulation to the inner surface of the envelope is effected in the same manner as that shown in FIG. 2. After naturally drying the thus-coated envelope, it is dried at about 150° C. The coating is applied to a desired thickness of 1 μm–10 μm by repeating the above procedure as needed. Upon heat treatment of the thus-coated envelope at a temperature of 500° C. or higher or preferably 800° C. or higher, an amorphous SiO2 layer is baked. In this layer, $TiO_2$ has already been dispersed as required in the present invention. It is understood that the present process is also easy and efficient like the above-described diffusion process.

By using a fused silica envelope produced in the above-described manner, a xenon lamp was assembled and then lit. Even after passage of 1,000 hours since its lighting, it did not develop any strain in the envelope, to say nothing of its fracture. It therefore demonstrated that its durability is sufficiently high. Since its u.v. transmission characteristics were as shown in FIG. 1, ultraviolet rays having wavelengths shorter than 200 nm and shorter were absorbed and were not allowed to penetrate to the outside. Therefore, it can successfully function as an ozone-free fused silica glass.

The term "discharge lamp" as used herein is not necessarily limited to mean xenon lamps. Needless to say, envelopes according to this invention can be used in various discharge lamps, including, rare gas discharge lamps, metal vapor discharge lamps such as mercury vapor lamps, and flash discharge lamps.

Having now fully described the invention, it will be apparent to one of ordinary skill in the art that many modifications and changes can be made thereto without departing from the spirit or scope of the invention as set forth herein.

What is claimed is:

1. A method for producing an envelope for a discharge lamp, comprising the steps of:

coating an inner surface of a fused silica tube with a formulation containing a titanium alcoholate;

drying the coated tube;

heating the dried coated tube at a temperature of at least 250° C. for approximately 10 minutes;

baking the coated tube at a temperature of at least 1720° C. to cause $TiO_2$ to diffuse into the tube to provide a Ti concentration of 0.5–7% by weight in terms of $TiO_2$ from the inner surface of the tube to a depth of at least 1 μm but not greater than 10 μm into the tube, and so that the product of the overall average Ti concentration and the thickness of the tube ranges from 3.7 μm to 40% μm; and forming a bulb-like portion by inflating the silica tube during said baking step.

2. The method as claimed in claim 1 wherein the coating formulation contains titanium-tetraethoxide and ethanol.

3. The method as claimed in claim 1 wherein said coating step comprises:

placing one end of the fused silica tube in the coating formulation; and extracting air from the other end of the tube so that the coating formulation rises in and substantially fills the interior of the tube and allowing the coating formulation to descend and empty from the interior of the tube to form a coating on the inner surface of the tube.

4. The method as claimed in claim 1 wherein said coating, drying and heating steps are repeated to form a coating with a thickness of 0.1–1 μm.

* * * * *

UNITED STATES PATENT AND TRADEMARK OFFICE

CERTIFICATE OF CORRECTION

PATENT NO. : 4,985,275

DATED : January 15, 1991

INVENTOR(S) : Tetsu Takemura et al.

It is certified that error appears in the above-identified patent and that said Letters Patent is hereby corrected as shown below:

Column 4, line 39, change "SiO2" to --$SiO_2$--.

Claim 1, column 5, line 9, insert --%-- after "0.5";

Claim 1, column 5, line 10, insert --,-- after "$TiO_2$"; and

Claim 1, column 5, line 15, change "3.7 μm to 40%" to --3.7% μm to 42%--.

Signed and Sealed this

Nineteenth Day of May, 1992

*Attest:*

DOUGLAS B. COMER

*Attesting Officer*

*Acting Commissioner of Patents and Trademarks*